US005802756A

United States Patent [19]

Hightower

[11] Patent Number: 5,802,756

[45] Date of Patent: Sep. 8, 1998

[54] ADJUSTABLE SLING FOR RIFLES, SHOTGUNS OR THE LIKE

[76] Inventor: Floyd Hightower, 1216 Western Ridge Dr., Waco, Tex. 76712

[21] Appl. No.: 857,184

[22] Filed: May 15, 1997

[51] Int. Cl.[6] ..... F41C 23/02

[52] U.S. Cl. ..... 42/85

[58] Field of Search ..... 42/85; 224/150, 224/913, 257, 258, 916, 917, 264

[56] References Cited

U.S. PATENT DOCUMENTS

| | | | |
|---|---|---|---|
| 1,843,061 | 1/1932 | Barnak | 42/85 |
| 3,050,734 | 8/1962 | Dopyera | 2/2 |
| 3,052,886 | 9/1962 | White | 2/2 |
| 3,495,770 | 2/1970 | Seltmann, Jr. et al. | 224/150 |
| 4,311,263 | 1/1982 | Bianchi | 224/150 |
| 4,401,246 | 8/1983 | Dickinson et al. | 224/150 |
| 4,511,070 | 4/1985 | Hightower | 224/150 |
| 4,768,689 | 9/1988 | Davis | 224/257 |
| 4,978,044 | 12/1990 | Silver | 224/202 |
| 5,129,564 | 7/1992 | Danezin | 224/264 |
| 5,282,558 | 2/1994 | Martinez | 224/150 |
| 5,332,137 | 7/1994 | Violette | 224/257 |
| 5,433,360 | 7/1995 | Rock | 224/258 |
| 5,575,411 | 11/1996 | Hightower | 224/149 |
| 5,613,316 | 3/1997 | Hightower | 42/85 |
| 5,615,811 | 4/1997 | Bell et al. | 224/150 |

*Primary Examiner*—Charles T. Jordan
*Assistant Examiner*—Meena Chelliah
*Attorney, Agent, or Firm*—Diller, Ramik & Wight, PC

[57] ABSTRACT

A firearm sling includes an elongated pad and a sling member which can be adjusted lengthwise absent any relative repositioning of the pad with respect to the sling member or an associated firearm. At one end the pad has a thumb loop for over-the-shoulder carrying of the firearm and at an opposite end the pad includes a protective piece of material for underlying an associated sling swivel to prevent damage to an associated firearm stock. Longitudinal axes of the pad and the sling member are maintained substantially aligned by two fabric webs each having an opposite end secured to the pad with the sling member being slidably retained between the fabric webs and pad.

36 Claims, 2 Drawing Sheets

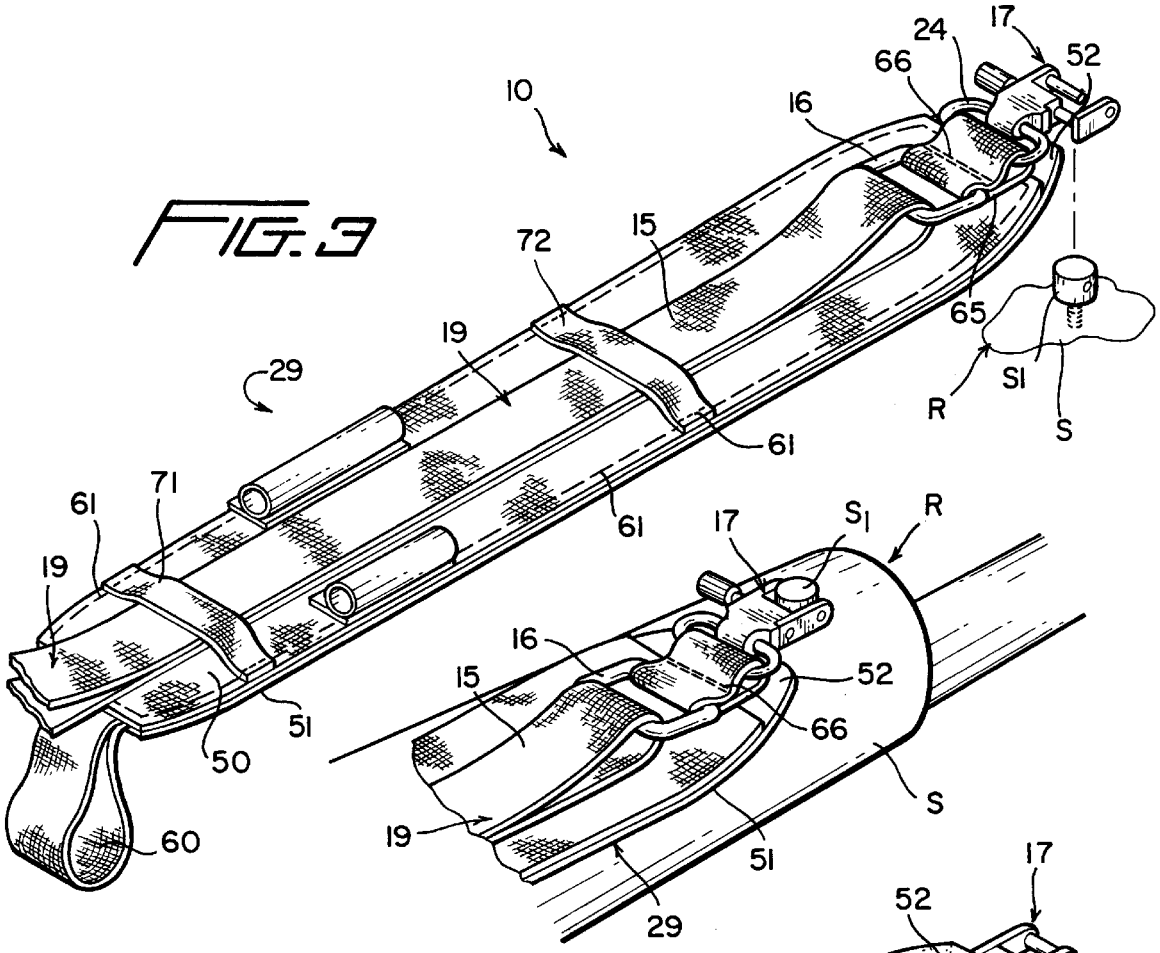
FIG. 3
FIG. 4
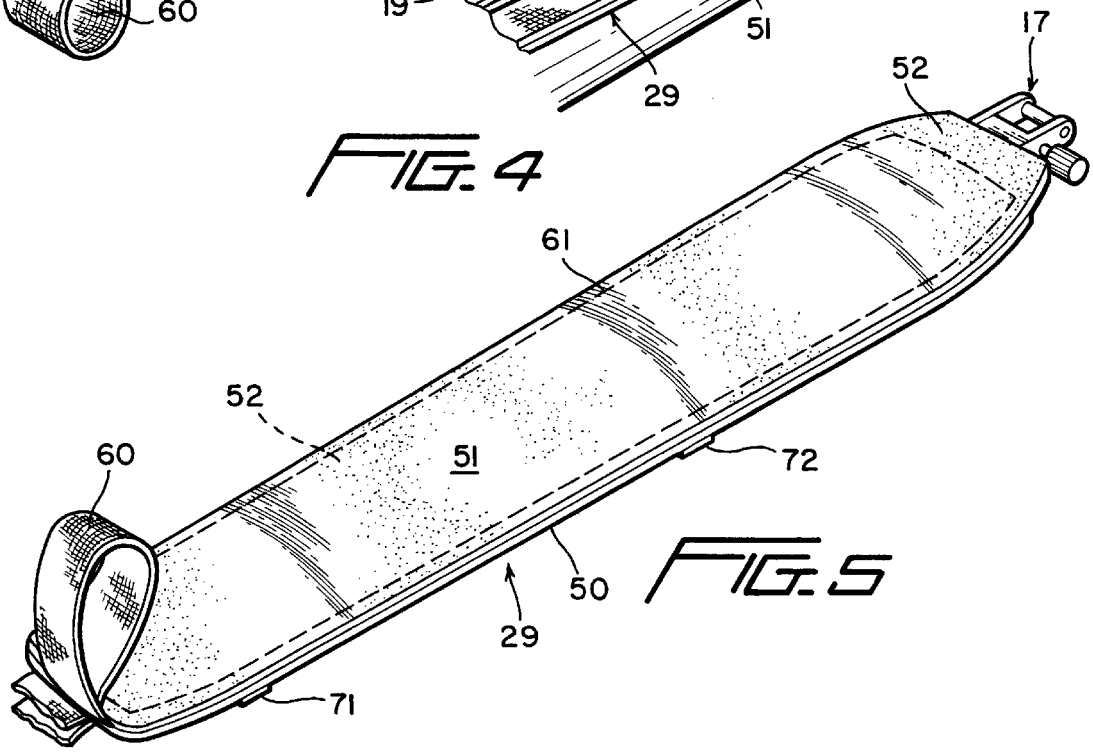
FIG. 5

ADJUSTABLE SLING FOR RIFLES, SHOTGUNS OR THE LIKE

BACKGROUND OF THE INVENTION

The invention is directed to a sling for a rifle, shotgun or similar firearm and is designed to be quickly adjustable while simultaneously being secured in any adjusted length thereby accommodating the sling to different measurements between sling swivel studs on the stocks of rifles and/or shotguns of different manufacturers.

U.S. Pat. No. 4,511,070 granted on Apr. 16, 1985 in the name of Floyd Hightower discloses a sling member which is adjusted in the manner just described. This sling member lacks, however, a shoulder pad for distributing the weight or load of the firearm over a person's shoulder and collar bone when the firearm is being carried in a conventional over-the-shoulder manner. One such typical sling employing a shoulder pad is disclosed in U.S. Pat. No. 4,311,263 granted on Jun. 19, 1982. The sling disclosed in the latter patent is also adjustable in length and includes a thumb hole in the narrower end of the shoulder pad for providing a natural hand hold when the firearm is shoulder carried.

SUMMARY OF THE INVENTION

The novel firearm sling of the present invention includes a conventional sling member of the type disclosed in the Hightower patent, but the novel sling additionally includes a relatively elongated shoulder pad to which is connected a conventional sling swivel which is in turn adapted to be connected to a sling swivel stud of a conventional firearm. The latter sling swivel is connected to an upper portion of a shoulder pad and a portion of the fabric from which the pad is constructed underlies the sling swivel to prevent the sling swivel from contacting and thus damaging the stock of an associated firearm.

The upper portion of the shoulder pad also has connected thereto by a separate loop an upper overfolded portion of the sling member which is also entrained through this separate loop. This slidable connection between the sling member and the pad allows the sling member to be adjusted as need be absent interference of the shoulder pad and with the shoulder pad at all times being located at the same position with respect to the overall sling and to the associated firearm to which it is connected.

The sling also includes one or more relatively narrow fabric retaining webs through which the overfolded upper end portion of the sling member passes in generally sliding relationship between the shoulder pad and the one or more retaining webs. The retaining webs thereby maintain a longitudinal axis of the shoulder pad aligned with a longitudinal axis of the sling member, thus preventing lateral shifting therebetween. This feature assures that the shoulder pad will not be displaced relative to the sling member during shoulder-carrying of the firearm while simultaneously permitting sling member adjustment because of the relative sliding movement of the overfolded upper portion of the sling member relative to and between the shoulder pad and the retaining member.

Lastly, a lower portion of the shoulder pad includes a thumb loop formed of web material having ends sewn to a lowermost end of the shoulder pad. The thumb loop functions in the same manner as that described in U.S. Pat. No. 4,311,263 during shoulder carrying, yet does not interfere with sling member adjustment.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 3 is a fragmentary enlarged perspective view of a portion of the sling, and illustrates in more detail a pair of narrow retaining webs, an upper overfolded portion of the sling member in sliding relationship between the retaining webs and the shoulder pad, a separate loop about which the overfolded portion of the sling member is entrained, a stock protector tab of the shoulder pad underlying a conventional sling swivel, and opposite the sling swivel a thumb loop sewn to the shoulder pad.

FIG. 4 is a fragmentary perspective view of the uppermost portion of the sling, and more clearly illustrates the manner in which the sling swivel is connected to a sling swivel stud of an associated firearm stock with the stock protector tab of the shoulder pad underlying the sling swivel.

FIG. 5 is a perspective view of the sling, and illustrates a side of the shoulder pad opposite to that illustrated in FIG. 3.

DESCRIPTION OF THE PREFERRED EMBODIMENT

Figure 1:
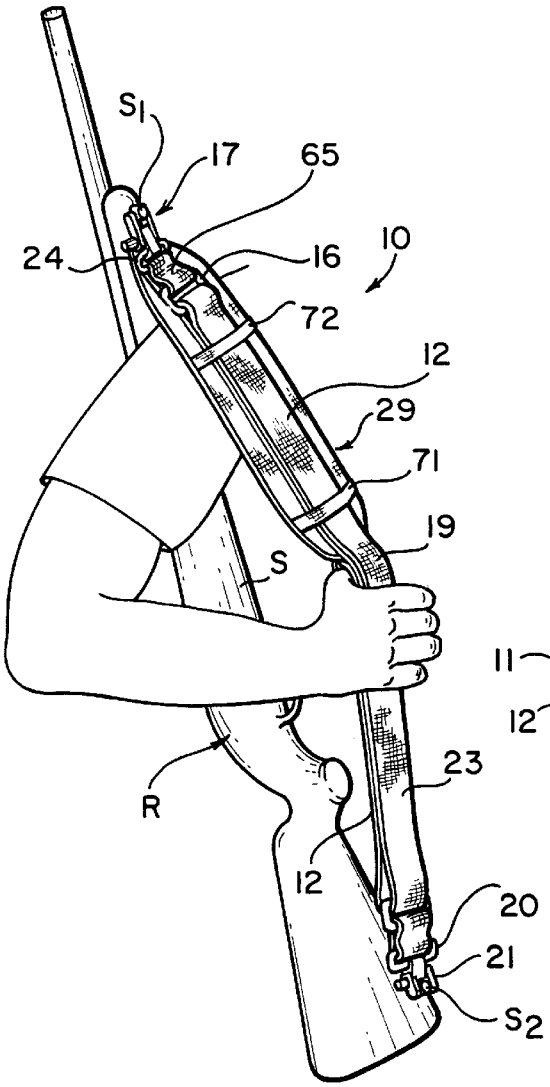
FIG. 1 is a perspective view of a novel sling constructed in accordance with this invention, and illustrates a sling member and a shoulder pad in assembled relationship to a firearm.

A novel sling constructed in accordance with this invention is generally designated by the reference numeral 10, and is defined by a sling member 19 and a substantially elongated shoulder pad 29.

Figure 2:
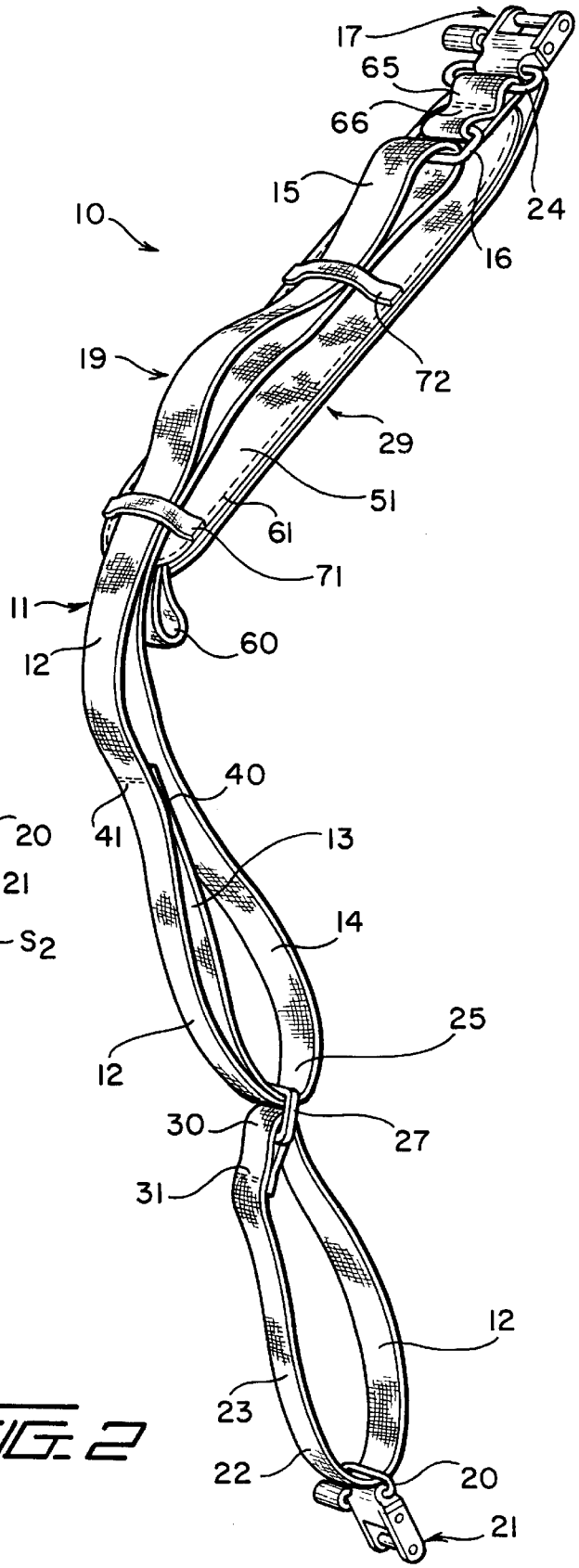
FIG. 2 is a perspective view of the sling of the invention, and more specifically illustrates details of the sling member, the shoulder pad, a stock protector tab of the shoulder pad, and a thumb loop of the shoulder pad.

The sling member 19 is preferably constructed from nylon webbing (MIL-W-27265C-Class R Resin Treated Type 25), and is substantially identical to the sling disclosed in U.S. Pat. No. 4,511,070. The webbing or elongated web is generally designated by the reference numeral 11 and includes a plurality of overfolded and/or superimposed web portions with a first web portion being generally designated by the reference numeral 12, a second web portion by the reference numeral 13 and a third web portion by the reference numeral 14. The second web portion 13 is generally sandwiched between the first web portion 12 and the third web portion 14, as is best illustrated in FIG. 2 of the drawings.

The web portions 12, 14 collectively define an overfolded upper terminal end portion, loop portion or web portion 15 which passes through a conventional separate metal polygonal loop 16 which is connected to a conventional detachable sling swivel 17 in a manner to be described more fully hereinafter. The sling swivel 17 is conventionally connected to a conventional sling swivel stud S1 (FIGS. 3 and 4) of a conventional rifle R, shotgun or similar firearm having a conventional stock S.

A duplicate conventional loop 20 and an associated conventional sling swivel 21 is connected to another conventional sling swivel stud S2 (FIG. 1) of the rifle R or a like firearm. The loop 20 is entrained by an overfolded lower end portion or web portion 22 which is longitudinally remote from the overfolded end portion 15 and is defined by a portion of the first web portion 12 and a fourth web portion 23.

The second and third web portions 13 and 14, respectively, cooperatively define a third overfolded web portion 25 which entrains and is partially entrained by a rectangular loop or loop member 27. The loop 27 is also entrained by a fourth overfolded web portion 30 which is in part formed as a continuation of the fourth web portion 23 passing through the loop 27. Connection means in the form of stitching 31 fastens overlying web portions (unnumbered) of the overfolded end portion 30 together to define a fixed terminal end of the overall sling member 19.

A terminal end 40 of the second web portion 13 is similarly connected by stitching 41 to the first web portion 12 after having first been passed through the loop 27 to form the overfolded end portion 25 in the manner earlier described. The first web portion 12 thus not only passes through the loop 27 but is also in sandwiched relationship between the overfolded end portion 25 and the overfolded end portion 30.

The sling member 19 can be readily and easily adjusted in length to vary the distance between the loops 16, 20 in the manner apparent from the description and accompanying illustration, but further details with respect thereto can be found in U.S. Pat. No. 4,511,070, column 2, beginning at line 57 and continuing through column 3, line 38.

Reference is made specifically to FIGS. 3 through 5 of the drawings and the details of construction of the illustrated elongated shoulder pad 29 which is formed of two relatively elongated pieces of material 50, 51 between which is sandwiched a relatively thick layer of padding material 52. At an upper end portion (unnumbered) of the shoulder pad 29 most adjacent the loop 16, a portion of the material 51, which is designated by the reference character 52, projects just beyond the edge (unnumbered) of the material 50 and underlies a metal loop 24 and a portion of the sling swivel 17 to thus function as a stock protector tab in the manner illustrated in FIG. 4 of the drawings. The pad portion 52 thus prevents either and/or both the loop 24 and the sling swivel 17 from continuously contacting the stock S to prevent the latter from damage, as occurs in conventional sling structures.

A thumb loop 60 is formed of web material and opposite ends thereof (unnumbered) are sandwiched between the two sheets or layers 50, 51 of the shoulder pad 29, after which peripheral stitching 61 secures the thumb tab 60 to the pad 29 in the manner illustrated, as well as peripherally binding the entire shoulder pad 29.

Securing means 65 (FIG. 3 and 4) in the form of a narrow web of material is entrained about the loop 16 and the loop 24 of the sling swivel 17. Stitching 66 serves as means for securing both loops 16, 24 to the shoulder pad 29 while permitting free articulation of the loop 24 relative to the overfolded web portion 65 and free sliding motion of the overfolded end portion 15 of the sling member 19 relative to the thumb loop 60.

The overfolded end portion 15 is also slidably retained in generally longitudinal alignment with a longitudinal axis (not shown) of the shoulder pad 29 by retaining means in the form of two spaced narrow webs or webbing 71, 72 (FIG. 3). The stitching 61 secures opposite terminal ends (unnumbered) of the narrow webbing 71, 72 to the shoulder pad 29. The retaining webs 71, 72 permit the rifle/firearm R to be carried in the manner best illustrated in FIG. 1 absent lateral shifting of the shoulder pad 29 relative to the sling member 19. Furthermore, the sling member 19 can be adjusted lengthwise absent interference because the web portions 12, 14 of the loop portion 15 can freely slide between the narrow web members 71, 72 and the sheet or layer 50 of the shoulder strap 29.

The sheet or piece of material 51 is preferably constructed from non-slipped material or material having a very low coefficient of friction so that the shoulder pad 29 will not slip from the shoulder when being carried. The opposite sheet 50 is preferably of a "camouflaged" appearance. Additionally, within the scope of the present invention, several cartridge loops 70 formed of webbing or canvas material can be sewn atop the sheet 50, preferably in pairs with the overfolded loop portion 15 disposed therebetween, as is shown in FIG. 3 of the drawings.

Although a preferred embodiment of the invention has been specifically illustrated and described herein, it is to be understood that minor variations may be made in the apparatus without departing from the spirit and scope of the invention, as defined the appended claims.

I claim:

1. A firearm sling comprising a substantially elongated pad having a pad upper portion and a pad lower portion, a substantially elongated sling member having a sling member upper fold portion and a sling member lower portion, first securing means for securing said pad upper portion to a stock of a firearm, second securing means for slidably securing said pad upper portion to said sling member upper fold portion, third securing means for securing said sling member lower portion to a stock of a firearm, and means for retaining said sling member upper fold portion in substantially sliding relationship to and along said pad.

2. The firearm sling as defined in claim 1 including fourth securing means for securing said second securing means to said pad upper portion.

3. The firearm sling as defined in claim 1 wherein said sling member upper fold portion is disposed in folded sliding relationship to said second securing means.

4. The firearm sling as defined in claim 1 wherein said second securing means includes a loop, and said sling member upper fold portion is disposed in folded sliding relationship to said loop.

5. The firearm sling as defined in claim 1 wherein said sling member includes means for selectively adjusting the length.

6. The firearm sling as defined in claim 1 including loop means for setting off and effecting relative adjustment of upper and lower sling member loops of said sling member.

7. The firearm sling as defined in claim 1 including loop means for setting off and effecting relative adjustment of upper and lower sling member loops of said sling member, said loop means includes a loop member disposed generally between and setting off said upper and lower sling member loops; said upper sling member loop having an upper fold in sliding relationship to said first securing means, a lower fold in sliding relationship to said loop member and an end portion in sliding relationship to said loop member; means for securing a terminal end portion of said upper sling member loop end portion to a medial portion of said upper sling member loop, and said lower sling member loop having a lower fold in sliding relationship to said third securing means.

8. The firearm sling as defined in claim 1 including loop means for setting off and effecting relative adjustment of upper and lower sling member loops of said sling member, said loop means includes a loop member disposed generally between and setting off said upper and lower sling member loops; said upper sling member loop having an upper fold in sliding relationship to said first securing means, a lower fold in sliding relationship to said loop member and an end portion in sliding relationship to said loop member; means for securing a terminal end portion of said upper sling member loop end portion to a medial portion of said upper sling member loop, said lower sling member loop having a lower fold in sliding relationship to said third securing means, and a portion of said sling member joins said upper and lower folds and is slidable through said loop means.

9. The firearm sling as defined in claim 1 wherein said retaining means is a retaining member in spanning relationship to said sling member upper fold portion.

10. The firearm sling as defined in claim 1 wherein said retaining means is a retaining member in spanning relationship to said sling member upper fold portion, and means for securing opposite ends of said retaining member to said pad.

11. The firearm sling as defined in claim 1 wherein said retaining means are a pair of retaining members in spanning relationship to said sling member upper fold portion.

12. The firearm sling as defined in claim 1 including a thumb loop carried by said pad at an end portion of said pad remote from said first securing means.

13. The firearm sling as defined in claim 1 wherein said pad upper portion includes a terminal end portion projecting in underlying relationship to said first securing means to protect the finish of an associated firearm stock to which the firearm sling is adapted to be attached.

14. The firearm sling as defined in claim 1 wherein said pad upper portion includes a terminal end portion projecting in underlying relationship to said first securing means to protect the finish of an associated firearm stock to which the firearm sling is adapted to be attached, said pad being formed of padding sandwiched between two sheets of material, stitching means for peripherally stitching said two sheets together, and said terminal end portion is defined by one of said sheets.

15. The firearm sling as defined in claim 7 including fourth securing means for securing said second securing means to said pad upper portion.

16. The firearm sling as defined in claim 7 wherein said sling member includes means for selectively adjusting the length.

17. The firearm sling as defined in claim 7 wherein said retaining means is a retaining member in spanning relationship to said upper sling member loop.

18. The firearm sling as defined in claim 7 wherein said retaining means is a retaining member in spanning relationship to said upper sling member loop, and means for securing opposite ends of said retaining member to said pad.

19. The firearm sling as defined in claim 7 wherein said pad upper portion includes a terminal end portion projecting in underlying relationship to said first securing means to protect the finish of an associated firearm stock to which the firearm sling is adapted to be attached.

20. A sling for a firearm comprising an elongated web of material folded upon itself to define axially opposite first and second overfolded end portions, a separate loop disposed between said overfolded end portions, means for connecting said separate loop to a first end of said web adjacent said first overfolded end portion; said web including first, second and third web portions disposed at least partially in superposed adjacent relatively sliding relationship; said first web portion passing through said separate loop and forming an integral extension between said first and second overfolded end portions, said second web portion being sandwiched between said first and third web portions, said second and third web portions collectively defining a third overfolded end portion passing through and partially entraining said separate loop, said first web portion being in sandwiched relationship to said third overfolded end portion and said web first end whereby said first web portion can be slid through said separate loop in either of two opposite directions to selectively lengthen or shorten the distance between said connecting means and said separate loop to thereby effectively lengthen or shorten said sling, a shoulder pad, and means for slidably securing said second overfolded end portion to said shoulder pad.

21. The sling as defined in claim 20 wherein said slidable securing means includes a loop through which said second overfolded end portion is partially entrained.

22. The sling as defined in claim 20 including means for fastening said shoulder pad to a stock of a firearm.

23. The sling as defined in claim 20 including means for fastening said shoulder pad to a stock of a firearm and said shoulder pad including means for underlying said fastening means to prevent damage to an associated stock.

24. The sling as defined in claim 20 including a thumb loop carried by said shoulder pad at an end portion of said shoulder pad substantially opposite from said last-mentioned loop.

25. The sling as defined in claim 20 including means for retaining said first and third web portions in generally sliding relationship to and along said shoulder pad.

26. The sling as defined in claim 20 wherein said slidable securing means includes a loop through which said second overfolded end portion is partially entrained, a separate short web of material entraining said last-mentioned loop, and means for stitching said short web to said pad.

27. The sling as defined in claim 20 wherein said slidable securing means includes a loop through which said second overfolded end portion is partially entrained, means for fastening said shoulder pad to a firearm stock, a separate short web of material entraining said fastening means and said last-mentioned loop, and means for stitching said short web to said pad.

28. The sling as defined in claim 26 including a thumb loop carried by said shoulder pad at an end portion of said shoulder pad substantially opposite from said last-mentioned loop.

29. The sling as defined in claim 26 including means for retaining said first and third web portions in generally sliding relationship to and along said shoulder pad.

30. A sling for a firearm comprising an elongated web of material folded upon itself to define axially opposite first and second overfolded end portions, a separate loop disposed between said overfolded end portions, means for connecting said separate loop to a first end of said web adjacent said first overfolded end portion; said web including first, second and third web portions disposed at least partially in superposed adjacent relatively sliding relationship; said first web portion passing through said separate loop and forming an integral extension between said first and second overfolded end portions, said second web portion being sandwiched between said first and third web portions, said second and third web portions collectively defining a third overfolded end portion passing through and partially entraining said separate loop, said first web portion being in sandwiched relationship to said third overfolded end portion and said web first end whereby said first web portion can be slid through said separate loop in either of two opposite directions to selectively lengthen or shorten the distance between said connecting means and said separate loop to thereby effectively lengthen or shorten said sling, an elongated shoulder pad having opposite end portions, means for securing said sling to a first end portion of said elongated shoulder pad, and a thumb loop formed of web material disposed at a second end portion of said elongated shoulder pad.

31. The sling as defined in claim 30 including means for retaining said first and third web portions in generally sliding relationship to and along said shoulder pad.

32. The sling as defined in claim 30 wherein said sling securing means includes a loop through which said sling is at least partially entraining, and a short loop of web material entraining said last-mentioned loop and being sewn to said shoulder pad.

33. A sling for a rifle, shotgun or the like comprising an elongated web of material folded upon itself to define axially opposite first and second overfolded end portions, a separate loop disposed between said overfolded end portions, means for connecting said separate loop to a first end of said web adjacent said first overfolded end portion; said web including first, second and third web portions disposed at least partially in superposed adjacent relatively sliding relationship; said first web portion passing through said separate loop and forming an integral extension between said first and second overfolded end portions, said second web portion being sandwiched between said first and third web portions, said second and third web portions collectively defining a third overfolded end portion passing through and partially entraining said separate loop, said first web portion being in sandwiched relationship to said third overfolded end portion and said web first end whereby said first web portion can be slid through said separate loop in either of two opposite directions to selectively lengthen or shorten the distance between said connecting means and said separate loop to thereby effectively lengthen or shorten said sling, an elongated shoulder pad having opposite end portions, means for securing said sling to a first end portion of said elongated shoulder pad, means for fastening said sling to a stock of a firearm, said fastening means being carried by said shoulder pad first end portion, and means at said shoulder pad first end portion for underlying said fastening means to prevent damage to an associated stock.

34. The sling as defined in claim 33 wherein said shoulder pad includes two pieces of material peripherally stitched together, and said damage preventing means is a portion of at least one of said two pieces of material.

35. The sling as defined in claim 33 wherein said shoulder pad includes two pieces of material peripherally stitched together, and said damage preventing means is a portion of at least one of said two pieces of material projecting beyond another of said two pieces of material.

36. The sling as defined in claim 34 including a thumb loop of web material projecting beyond said shoulder pad and having ends sandwiched between and sewn to said two pieces of material.

* * * * *